United States Patent [19]

Camerano

[11] 4,031,916

[45] June 28, 1977

[54] FITTING FOR A RADIATOR IN A SINGLE DUCT HEATING SYSTEM

[75] Inventor: Angelo Camerano, Savona, Italy

[73] Assignee: Monorapid S.A.S. di Camerano Angelo & C., Sanova, Italy

[22] Filed: Mar. 12, 1975

[21] Appl. No.: 557,868

[30] Foreign Application Priority Data

Mar. 13, 1974 Italy ..... 12530/74

[52] U.S. Cl. ..... 137/561 A; 237/70; 285/158; 285/222

[51] Int. Cl.[2] ..... F16L 41/02

[58] Field of Search ..... 137/561 R, 561 A, 360, 137/361; 237/71, 72, 74, 75, 70; 285/222, 158

[56] References Cited

UNITED STATES PATENTS

| | | | |
|---|---|---|---|
| 926,552 | 6/1909 | Doyle | 137/360 |
| 1,125,063 | 1/1915 | Colberg | 285/222 |
| 2,889,856 | 6/1959 | Magnuson | 137/610 |
| 2,913,259 | 11/1959 | Rings | 137/561 R |
| 2,966,373 | 12/1960 | Yount | 285/222 |

*Primary Examiner*—Martin P. Schwadron
*Assistant Examiner*—H. Jay Spiegel
*Attorney, Agent, or Firm*—Pollock, Vande Sande & Priddy

[57] ABSTRACT

A fitting for joining a radiator to the main flow pipe of a single duct heating system comprises a housing which defines an inflow duct for connection to the upstream section of the main flow pipe, an outflow duct for connection to the downstream section of the main flow pipe, an inlet duct for connection to the inlet conduit of the radiator and a return duct for connection to the return conduit from the radiator. The return duct consists of a piece of bent pipe, arranged at the interior of the housing, said return duct entering in the space of the outflow duct at right angles with respect to the axis of the said overflow duct, and then making a bend so as to become parallel to the mentioned axis, in order to discharge the return water in the same direction of flow of the water in the outflow duct.

5 Claims, 6 Drawing Figures

FITTING FOR A RADIATOR IN A SINGLE DUCT HEATING SYSTEM

SUMMARY OF THE INVENTION

The present invention relates to a fitting for joining a radiator to the main flow pipe, in a single duct heating system of the type in which a single main pipe serves for supplying the heating fluid (water) to a radiator and for returning the said heating fluid therefrom.

The fitting according to the present invention is very simple in construction, not expensive and does not require any particular adjustment at the moment of its connection to the apparatus except for the simple connection of its pipe unions to the main flow pipe sections and to the conduits to and from the radiator. Consequently, after having provided for this stable connection, the fitting can be embedded in the wall, thus avoiding the unaesthetic appearance of pipe joints or bulky fittings in proximity to the radiator.

According to the invention, the fitting for joining the radiator to the main flow pipe is constructed as a single-piece housing provided with four pipe unions for connection to the main flow pipe and to the conduits to and from the radiator. In a preferred embodiment, the housing comprises, at its interior, an inflow duct, to be connected to the upstream section of the main flow pipe, from which inflow duct there departs an inlet duct for supplying hot water to the radiator, and which continues into an outflow duct, to be connected to the downstream section of the main flow pipe. In the housing there is further provided a pipe union which is axially perpendicular to the axis of the outflow duct, and into which there is fitted an open ended piece of pipe which enters into the outflow duct at the interior of the housing at right angles and then it is so curved as to terminate with its free end in a direction which is parallel to the axis of the said outflow duct. This latter pipe union is connected to a return conduit from the radiator, so that the return water enters into the housing without disturbing the flow of the water in the outflow duct, and it is practically injected into the flow of water in the zone of the said outflow duct, in a direction which substantially coincides with the direction of the said flow. In this manner, the formation of turbulence is avoided, and perfect mixing of the return water from the radiator with the water of the main flow pipe is assured.

Further advantages and characteristic features of the invention will appear evident from the following description of preferred embodiments of same, made with reference to the attached sheets of drawings.

DESCRIPTION OF THE PREFERRED EMBODIMENT

Figures 1, 2, 6:
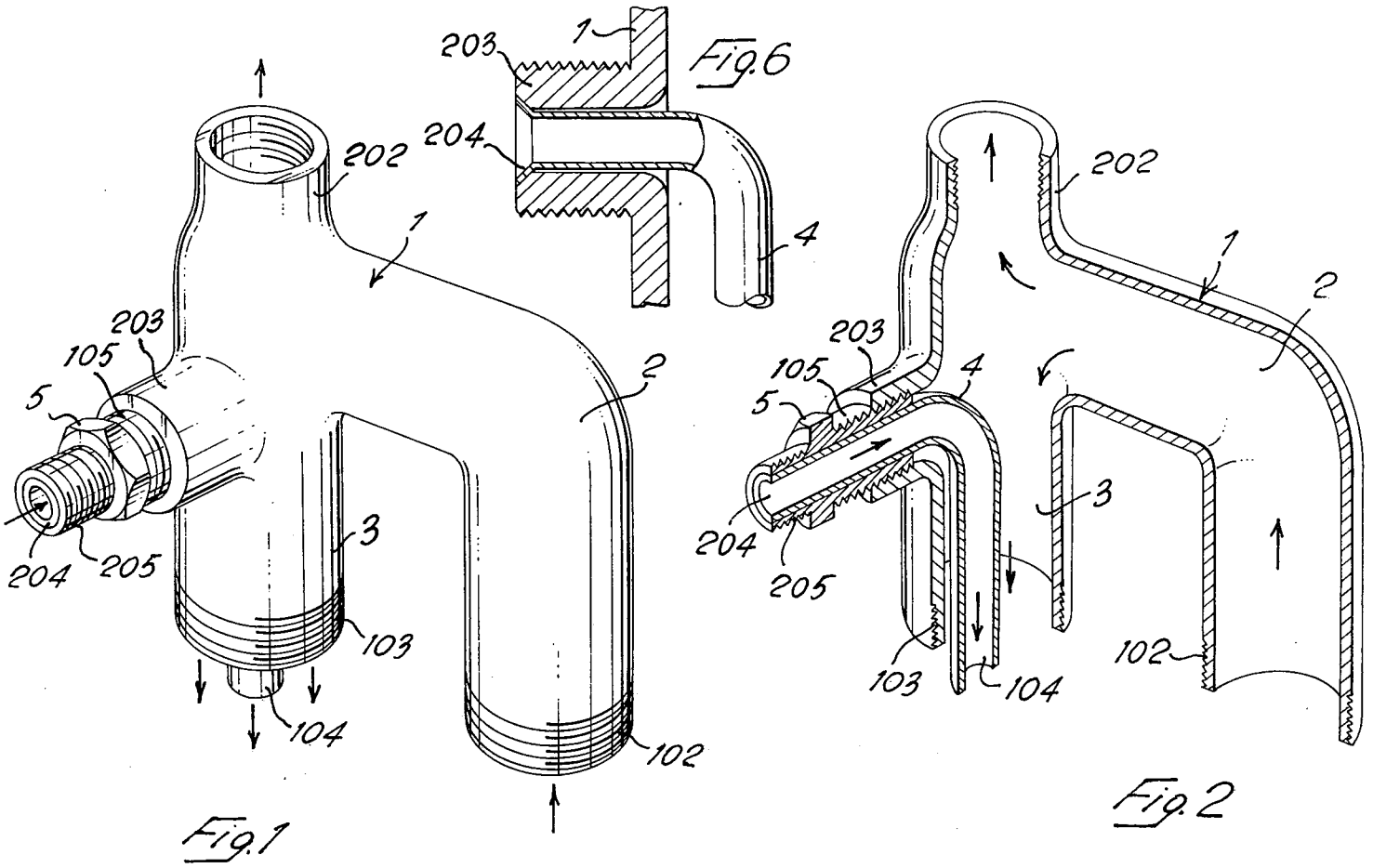
FIG. 1 is a perspective view of a fitting in accordance with the invention.
FIG. 2 is a perspective view of the same fitting shown in FIG. 1, sectioned along two perpendicular planes.
FIG. 6 is a section showing a modified embodiment of a particular of the fitting according to the invention.
Figure 3:
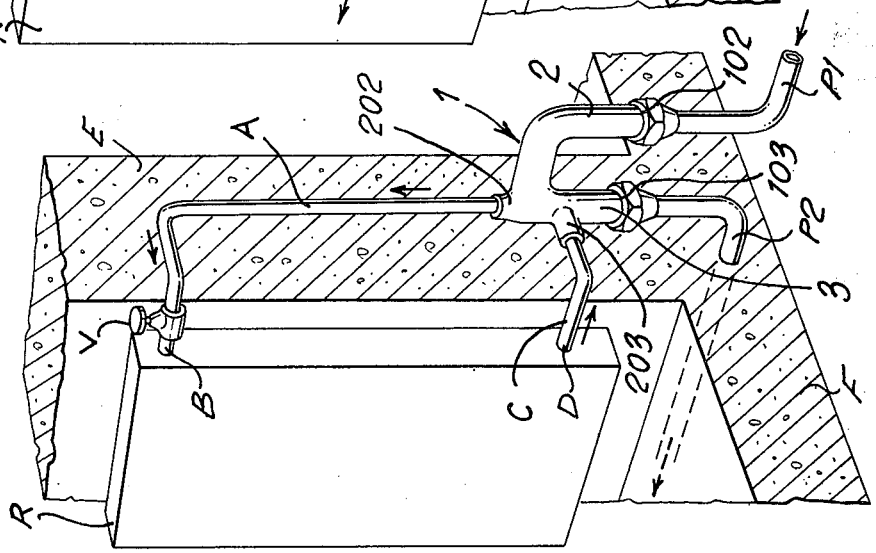
FIG. 3 is a perspective view of the fitting according to FIGS. 1 and 2, as applied to a radiator in a single duct heating system.

Referring to FIGS. 1 to 3, the pipe fitting in accordance with the invention is intended to connect the radiator or heater element R of a single duct heating system with the upstream section P1 and with the downstream section P2 of the main flow pipe. The pipe fitting consists with a four-way housing 1 which presents an inflow duct 2 and an outflow duct 3. In correspondence of the lower end of the inflow duct 2 there is provided a pipe union 102, adapted to be connected to the upstream section P1 of the main flow pipe. Starting from this pipe union 102, the inflow duct 2 goes upwardly in a substantially vertical direction, then makes a 90° bend so as to present a substantially horizontal section. In correspondence with the end (in the direction of the flow) of this horizontal section of the inflow duct 2 there departs an upwardly direct section which terminates with a pipe union 202, which is intended to be connected to the upwardly directed inlet pipe A which, through the valve V and the upper lead-in passage B, connects the inflow duct 2 to the said radiator. This upwardly directed section therefore practically constitutes the inlet duct or passage for the heating water to the radiator.

In correspondence of the mentioned end (in the direction of flow) of the horizontal section of the inflow duct 2 there departs a downwardly directed outflow branch or duct 3, which is provided at its lower end with a pipe union 103, for connection with the downstream section P2 of the main flow pipe. It appears therefore that, in correspondence of the said end of the horizontal section of the inflow duct 2 there depart, in parallel, two branches or ducts directed in opposed directions, for providing, respectively, the inlet duct for the radiator, and the outflow duct to the main flow pipe. It appears also evident that inflow duct 2 and outflow duct 3 constitute a by-pass flow passage with respect to the upwardly directed inlet duct for the radiator, terminating with the pipe union 202.

At right angles with respect to the outflow duct 3 there is provided a pipe union 203, which is intended to be connected to the outlet D of the radiator R through a return pipe C. This pipe union 203 serves for the connection of the outlet D of the radiator (though the pipe C) to the return duct 4 which is a pipe housed inside the housing 1, and more particularly is constructed as a pipe presenting a 90° bend, and an outer diameter which is smaller than the inside diameter of the outflow duct 3, the bent portion of the said pipe 4 being directed so as to be axially parallel to the axis of the said outflow duct 3, and opening with an outlet 104 in the same direction as the direction of flow of the heating fluid in the said outflow duct 3.

In the embodiment of FIGS. 1 and 2 the return pipe or duct 4 is fitted onto the union 203 in a tight manner, by being fitted in a nipple joint 5, presenting two threaded sections 105, 205 respectively for connection with the union 203 and with the radiator outlet pipe C. In the embodiment shown in FIG. 6, the tight seal between the pipe 4 and the union 203 is obtained by flaring out and enlarging the end portion of pipe 4, as shown at 204, and fitting it on a correspondingly shaped seat provided at the extremity of the pipe union 203 itself.

As can be appreciated from FIG. 3, the embodiment shown in FIGS. 1 to 3 is particularly adapted for single duct heating systems, where the main flow pipe is embedded in the floor F, while the fitting 1 is embedded in the wall E, together with portions of the pipes A and C. The valve V serves for regulating the flow of hot water inside radiator R. Of course, if valve V is completely closed, radiator R is excluded from the heating circuit, and the hot water or fluid will by-pass the radiator by flowing through ducts 2 and 3, while no flow will occur through the radiator inlet duct at union 202 and through the radiator return duct 4 at union 203.

During normal operation of the heating system the hot water coming from the main flow pipe will flow through inflow duct 2 and partially (depending upon the dimensions of the radiator and the adjustment of inlet valve V) into the radiator R through the inlet duct at union 202. A substantial part of the main flow coming from the main flow pipe will flow through outflow duct 3, to a subsequent section of the main flow pipe, thus by-passing the inlet duct of union 202. The heating water will flow out of the radiator R through return duct 4 at union 203. It is to be noted that, thanks to the particular bent shape of duct 4, the outlet flow from the radiator will be mixed with the main flow of water in the outflow duct by being concurrently (i.e., in the same direction of flow) injected into said flow. It will be appreciated that, because of this arrangement, no turbulence is created by the mixing of the two flows (the main flow and the outlet flow returning from the radiator).

MODIFICATIONS

Figure 4:
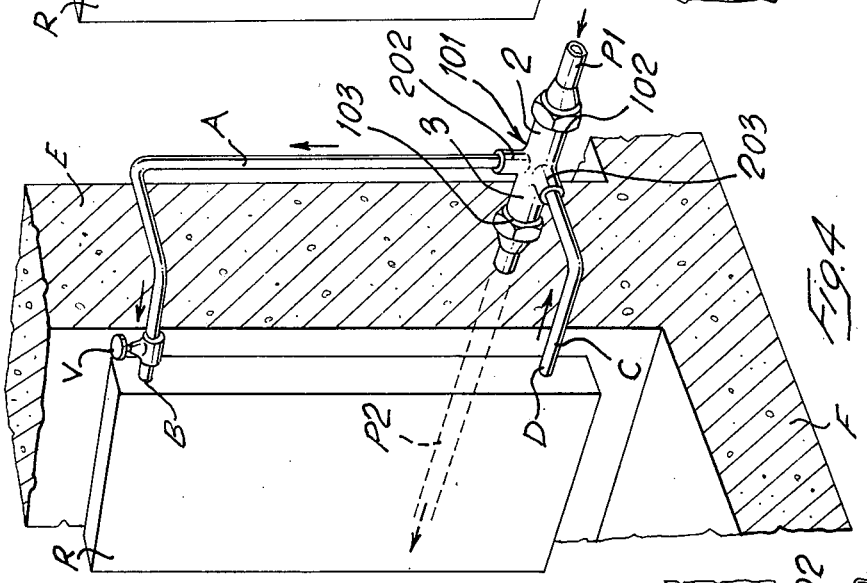
FIG. 4 is a perspective view of a modified embodiment of a fitting in accordance with the invention, as applied to a radiator in a single duct heating system.

The embodiment shown in FIG. 4 relates to a fitting which is particularly adapted for single duct heating systems where the main flow pipe runs above the floor level, and is embedded in the wall E. It is to be noted that in this embodiment the inflow duct 2 is co-axial to the outflow duct 3. The shape and arrangement of the bent pipe 4 which realizes the outlet duct from the radiator R is the same, so that, though entering the fitting at 90° with respect to the co-axially aligned inflow and outflow ducts, said duct or pipe 4 terminates with its free end directed in the same direction of the flow in the outflow duct.

Figure 5:
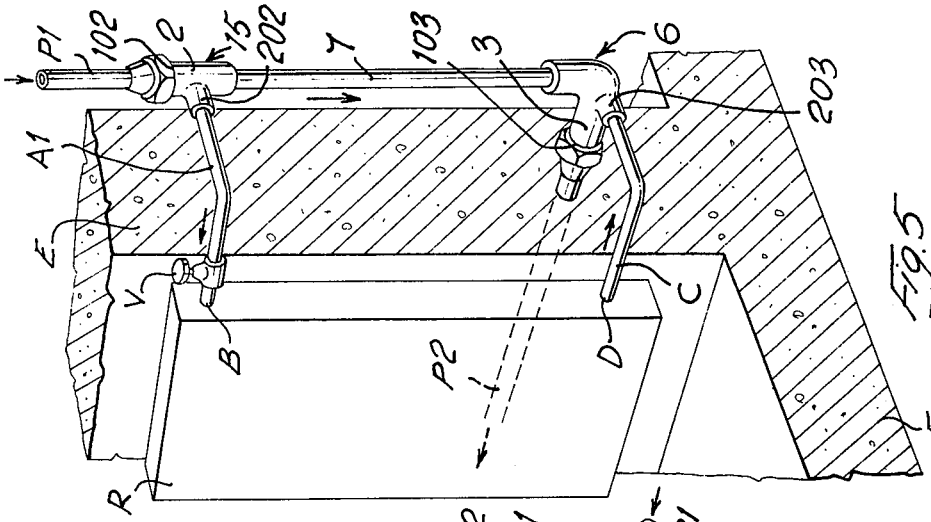
FIG. 5 is a perspective view of another modified embodiment of a fitting in accordance with the invention, as applied to a radiator in a single duct heating system.

The embodiment shown in FIG. 5 relates to a fitting which is particularly adapted for a single duct heating system where at least one radiator must receive the heating water from a higher level, so that the upstream section P1 of the main flow pipe is directed downwardly. In this case, the fitting is constructed of two separate housings of which one constitutes the inflow duct section 2 presenting a branch for feeding hot water to the radiator through pipe A1, while the second one constitutes the outflow duct section 3, connected to the downstream section P2 of the main flow pipe, and receiving the hot water from section 2 through pipe 7, and the return water from the radiator R through pipe C from duct 4 (not shown) at outlet duct union 3, in the same manner as for the other embodiments.

I claim:

1. In a single duct heating system, of the type in which a single main flow pipe serves for supplying heating water to a radiator and for returning water therefrom, a fitting for joining a radiator to the main flow pipe, said fitting being in the form of a housing comprising:
   a. an inflow duct connected to the main flow pipe through a pipe union;
   b. an inlet duct for the radiator veering off from the said inflow duct at an upward angle and connected to an inlet pipe for the radiator through a pipe union, said inlet duct defining an inlet axis;
   c. an outflow duct connected to the main flow pipe through a pipe union, said outflow duct being a continuation of the inflow duct veering off therefrom in a downward direction and defining an outflow axis coaxial with said inlet axis;
   d. a further pipe union for connection to a return conduit from the radiator, said pipe union being arranged with its axis perpendicular to the outflow axis of the outflow duct;
   e. a return duct consisting of an open ended pipe section disposed within the housing, said pipe section being tightly fitted by one of its ends into the said further pipe union and by the other of its ends into the outflow duct and having a bend therein of substantially 90° so that the said ends are substantially perpendicular to each other, whereby the return flow from the radiator flows in the same direction as the outflow in the outflow duct.

2. In a single duct heating system, a fitting according to claim 1, in which the free end of the return duct opening inside the outflow duct terminates at substantially the same height as the pipe union of the outflow duct.

3. In a single duct heating system, a fitting according to claim 1, in which the open ended pipe section constituting the return duct is fitted inside a nipple joint provided with two threaded sections of which one threaded section serves for fitting the nipple onto the corresponding pipe union of the housing, while the other threaded section serves for connecting the nipple, and the associated pipe fitted thereinto, to the return conduit from the radiator.

4. In a single duct heating system, a fitting according to claim 1, in which the open ended pipe section constituting the return duct is fitted into the corresponding pipe union by a flared end on said pipe section seating in a tight manner onto a correspondingly shaped section of the said further pipe union.

5. In a single duct heating system, a fitting according to claim 1, in which the pipe union for the inflow duct from the upstream section of the main flow pipe and the pipe union for the outflow duct to the downstream section of the main flow pipe are parallel to each other and spaced apart.

* * * * *